US011641956B2

(12) United States Patent
Austin, III et al.

(10) Patent No.: US 11,641,956 B2
(45) **Date of Patent: *May 9, 2023**

(54) SHOWER DOOR ASSEMBLY DISPLAY

(71) Applicant: LIBERTY HARDWARE MFG. CORP., Wintson-Salem, NC (US)

(72) Inventors: James Allen Austin, III, High Point, NC (US); Matthew Klein, Apex, NC (US); Patrick Boehnen, Summerfield, NC (US); Laura Hawkins, Madison, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/070,044

(22) Filed: Nov. 28, 2022

(65) Prior Publication Data

US 2023/0088215 A1 Mar. 23, 2023

Related U.S. Application Data

(60) Continuation of application No. 17/344,050, filed on Jun. 10, 2021, which is a division of application No.
(Continued)

(51) Int. Cl.
*A47F 7/00* (2006.01)

(52) U.S. Cl.
CPC ..... *A47F 7/0042* (2013.01); *Y10T 29/49826* (2015.01)

(58) Field of Classification Search
CPC ..... A47F 7/00; A47F 7/0042; Y10T 29/49826
See application file for complete search history.

(56) References Cited

U.S. PATENT DOCUMENTS 475,948 A 5/1892 Pease
739,027 A 9/1903 Raum
(Continued)

FOREIGN PATENT DOCUMENTS

CA 2505163 A1 10/2006
CN 203175303 U 9/2013
(Continued)

OTHER PUBLICATIONS

Sterling, A Kohler Company, "Installation Guide, Bypass Shower Doors", SP5900 Series, 2004, 16 pages.
(Continued)

*Primary Examiner* — Stanton L Krycinski
(74) *Attorney, Agent, or Firm* — Brooks Kushman P.C.; Lora Graentzdoerffer

(57) ABSTRACT

A retail shower door display assembly is provided with a point-of-sale display unit sized to be received within a retail store aisle. A first array of shower door glass panes is oriented within the display unit. Each shower door glass pane of the first array has a height, a thickness and a width. A second array of shower door glass panes is oriented within the display unit. Each shower door glass pane of the second array has a height, a thickness and a width that is different than the width of the first array of shower door glass panes. An array of shower door tracks is oriented within the display unit. Each shower door track of the array has a common length. An array of towel bars is oriented within the display unit. Each towel bar of the array has a common length.

13 Claims, 4 Drawing Sheets

Related U.S. Application Data

16/058,244, filed on Aug. 8, 2018, now Pat. No. 11,058,237, and a division of application No. 15/950,400, filed on Apr. 11, 2018, now Pat. No. 11,089,887, said application No. 16/058,244 is a division of application No. 14/167,230, filed on Jan. 29, 2014, now Pat. No. 10,070,739, said application No. 15/950,400 is a continuation of application No. 14/167,230, filed on Jan. 29, 2014, now Pat. No. 10,070,739.

(56) References Cited

U.S. PATENT DOCUMENTS

| | | | | |
|---|---|---|---|---|
| 805,570 | A | 11/1905 | Maldaner | |
| 865,465 | A | 9/1907 | Williams | |
| 949,915 | A | 2/1910 | Schreiber | |
| 965,099 | A * | 7/1910 | Forgy | A47F 7/0042 211/41.16 |
| 1,242,872 | A | 10/1917 | Saunders | |
| 1,530,211 | A | 3/1925 | Siemnash | |
| 1,688,255 | A | 10/1928 | Wasch | |
| 1,714,692 | A | 5/1929 | Pagel et al. | |
| 1,736,828 | A | 11/1929 | Lobban | |
| 1,841,620 | A | 1/1932 | McCoy | |
| 1,927,837 | A | 9/1933 | Kingdon | |
| 2,113,288 | A | 4/1938 | Berger | |
| 2,223,770 | A | 12/1940 | Nagle | |
| D129,731 | S | 9/1941 | Luttrell | |
| 2,290,104 | A | 7/1942 | Larson | |
| 2,501,609 | A | 3/1950 | Midouhas | |
| D165,358 | S | 12/1951 | Baldwin | |
| D174,553 | S | 4/1955 | Harris | |
| 2,879,899 | A | 3/1959 | Shenkin | |
| 2,884,136 | A | 4/1959 | Leighton | |
| 2,887,219 | A | 5/1959 | Lester, Jr. | |
| 2,937,743 | A | 5/1960 | Buttery et al. | |
| 2,944,679 | A | 7/1960 | Rubenstein | |
| 2,950,001 | A | 8/1960 | Bucko | |
| 3,033,356 | A | 5/1962 | Meyerson | |
| 3,095,970 | A | 7/1963 | Gaulke | |
| 3,108,657 | A | 10/1963 | Carlson | |
| 3,121,511 | A | 2/1964 | Whitehead | |
| 3,175,694 | A | 3/1965 | Reibold et al. | |
| D202,485 | S | 10/1965 | Fletcher et al. | |
| 3,233,753 | A | 2/1966 | Rich | |
| 3,347,357 | A | 10/1967 | Soto et al. | |
| 3,359,573 | A | 12/1967 | Casebolt | |
| 3,361,330 | A | 1/1968 | Ameson | |
| 3,385,451 | A | 5/1968 | Anderson | |
| D211,321 | S | 6/1968 | Ullmann | |
| 3,388,787 | A | 6/1968 | Growney | |
| 3,403,777 | A | 10/1968 | Bucko | |
| 3,468,593 | A | 9/1969 | Catlett | |
| 3,517,459 | A | 6/1970 | Schupper | |
| 3,517,801 | A | 6/1970 | Cote | |
| D224,692 | S | 8/1972 | Gray | |
| 3,732,633 | A | 5/1973 | Margolis et al. | |
| D227,351 | S | 6/1973 | Winton | |
| 3,777,883 | A | 12/1973 | Hackenberg | |
| 3,777,896 | A | 12/1973 | Ehrlich | |
| 3,889,813 | A | 6/1975 | Wright | |
| 3,935,949 | A | 2/1976 | Cohen | |
| D240,503 | S | 7/1976 | Crescenzi et al. | |
| 4,105,125 | A | 8/1978 | Magness | |
| 4,109,786 | A | 8/1978 | Roccaforte et al. | |
| 4,145,849 | A | 3/1979 | Shindoll et al. | |
| 4,241,832 | A | 12/1980 | Bliss | |
| 4,256,043 | A | 3/1981 | Ovitz, III | |
| D259,161 | S | 5/1981 | Thauer | |
| 4,315,569 | A | 2/1982 | Jaeschke | |
| 4,342,268 | A | 8/1982 | Grava | |
| 4,378,905 | A | 4/1983 | Roccaforte | |
| 4,385,687 | A | 5/1983 | Dutcher | |
| 4,429,791 | A | 2/1984 | Ruppel et al. | |
| 4,634,010 | A | 1/1987 | Otema | |
| 4,705,175 | A | 11/1987 | Howard et al. | |
| 4,720,876 | A | 1/1988 | Tomei et al. | |
| 4,750,609 | A | 6/1988 | Felis | |
| 4,762,235 | A | 8/1988 | Howard et al. | |
| 4,909,396 | A * | 3/1990 | Younger, Jr. | A47F 7/0042 211/41.15 |
| 5,031,781 | A | 7/1991 | Price et al. | |
| D319,934 | S | 9/1991 | Terrell et al. | |
| D323,986 | S | 2/1992 | Ferrero | |
| 5,111,943 | A | 5/1992 | Ramey | |
| 5,152,689 | A * | 10/1992 | Kurzman | G09B 25/00 434/72 |
| D332,744 | S | 1/1993 | McCooey | |
| 5,234,113 | A | 8/1993 | Ramey | |
| D343,075 | S | 1/1994 | Cappel, III | |
| 5,297,685 | A | 3/1994 | Ramey | |
| 5,305,898 | A | 4/1994 | Meri | |
| D349,458 | S | 8/1994 | Verdaguer | |
| 5,346,076 | A | 9/1994 | Hart | |
| 5,348,167 | A | 9/1994 | Jensen | |
| 5,368,486 | A | 11/1994 | Kurzman | |
| 5,372,278 | A | 12/1994 | Leight | |
| D355,586 | S | 2/1995 | Wang | |
| 5,467,915 | A | 11/1995 | Mattson | |
| 5,503,278 | A | 4/1996 | Ishmael | |
| 5,509,541 | A | 4/1996 | Meri | |
| D372,816 | S | 8/1996 | Rose et al. | |
| 5,547,053 | A | 8/1996 | Liang | |
| D377,144 | S | 1/1997 | Sawa | |
| D383,335 | S | 9/1997 | Shanahan et al. | |
| 5,675,936 | A | 10/1997 | Kurth et al. | |
| D392,820 | S | 3/1998 | Shanahan et al. | |
| 5,769,247 | A | 6/1998 | Meri | |
| D396,805 | S | 8/1998 | Broyles | |
| 5,822,810 | A | 10/1998 | Chen | |
| 5,823,339 | A | 10/1998 | Dunham et al. | |
| 5,848,446 | A | 12/1998 | DeBraal | |
| 5,860,526 | A | 1/1999 | Burke, Jr. | |
| D405,369 | S | 2/1999 | Dohner | |
| 5,887,782 | A | 3/1999 | Mueller | |
| D409,858 | S | 5/1999 | Reed | |
| 5,941,384 | A | 8/1999 | Schonhardt et al. | |
| D417,978 | S | 12/1999 | Reed | |
| D425,972 | S | 5/2000 | Smale | |
| 6,102,206 | A | 8/2000 | Pride | |
| 6,102,502 | A | 8/2000 | Melillo et al. | |
| 6,105,796 | A | 8/2000 | Buchanan et al. | |
| 6,170,675 | B1 | 1/2001 | Follman et al. | |
| 6,182,738 | B1 | 2/2001 | Chen | |
| 6,250,044 | B1 | 6/2001 | Funk et al. | |
| 6,286,692 | B1 * | 9/2001 | Hemping | A47F 7/00 211/96 |
| D451,305 | S | 12/2001 | Chang et al. | |
| D451,801 | S | 12/2001 | Schillinger | |
| 6,340,092 | B1 | 1/2002 | McGrath, Jr. | |
| D454,067 | S | 3/2002 | Schoening et al. | |
| 6,389,991 | B1 | 5/2002 | Morrisson | |
| D461,974 | S | 8/2002 | Hayden | |
| 6,461,705 | B2 | 10/2002 | Eichhorn | |
| 6,467,856 | B1 | 10/2002 | Chang et al. | |
| 6,484,890 | B1 | 11/2002 | Miller | |
| D466,804 | S | 12/2002 | Solland | |
| D469,349 | S | 1/2003 | Meeker et al. | |
| 6,594,973 | B1 | 7/2003 | Alpert et al. | |
| D482,265 | S | 11/2003 | Wicha | |
| 6,672,546 | B2 | 1/2004 | Calleja | |
| 6,681,445 | B2 | 1/2004 | Huang | |
| 6,701,672 | B2 | 3/2004 | Teubert et al. | |
| 6,811,046 | B2 | 11/2004 | Stein | |
| 6,850,208 | B1 | 2/2005 | Ferrante | |
| 6,895,714 | B2 | 5/2005 | Teubert et al. | |
| D507,741 | S | 7/2005 | Lu et al. | |
| 6,913,151 | B2 | 7/2005 | Stevenson | |
| 6,935,514 | B2 | 8/2005 | Lackey et al. | |
| 7,137,172 | B2 | 11/2006 | Elmer | |
| 7,150,361 | B2 | 12/2006 | Calleja | |
| 7,178,681 | B2 | 2/2007 | Libman | |
| 7,264,126 | B1 | 9/2007 | Bergeron | |

(56) References Cited

U.S. PATENT DOCUMENTS

| | | | | |
|---|---|---|---|---|
| 7,273,084 | B2 | 9/2007 | Chen | |
| 7,334,381 | B2 | 2/2008 | Mertz, II et al. | |
| 7,346,939 | B2 | 3/2008 | Perry | |
| D584,528 | S | 1/2009 | Neff et al. | |
| 7,481,323 | B2 * | 1/2009 | Fisher | B05B 13/0285 211/196 |
| D588,905 | S | 3/2009 | Meeks et al. | |
| 7,513,636 | B2 | 4/2009 | Beasley | |
| D593,409 | S | 6/2009 | Blick | |
| D594,742 | S | 6/2009 | Meier et al. | |
| 7,562,949 | B1 | 7/2009 | Nielsen | |
| D600,110 | S | 9/2009 | Cain | |
| 7,637,059 | B2 | 12/2009 | Chang et al. | |
| D607,724 | S | 1/2010 | Dreier et al. | |
| 7,748,527 | B2 | 7/2010 | Wisecarver et al. | |
| 7,762,508 | B2 | 7/2010 | Xu | |
| D622,083 | S | 8/2010 | Linder | |
| 7,828,151 | B2 | 11/2010 | Murdoch et al. | |
| 7,841,048 | B2 | 11/2010 | Tsai | |
| 7,900,784 | B1 | 3/2011 | Weigand et al. | |
| D639,652 | S | 6/2011 | Abdalkhani et al. | |
| 7,962,998 | B2 | 6/2011 | Proctor et al. | |
| D652,717 | S | 1/2012 | Shimoyama et al. | |
| 8,151,385 | B2 | 4/2012 | Goskowski et al. | |
| D660,988 | S | 5/2012 | Amend | |
| 8,191,707 | B2 | 6/2012 | McDonald et al. | |
| D668,540 | S | 10/2012 | Lutzig | |
| 8,312,998 | B2 | 11/2012 | Theisen | |
| D685,260 | S | 7/2013 | Thielemier | |
| 8,490,331 | B2 | 7/2013 | Quesada | |
| D689,360 | S | 9/2013 | Adams | |
| D690,592 | S | 10/2013 | Ding | |
| D690,593 | S | 10/2013 | Kaps et al. | |
| D694,099 | S | 11/2013 | Ensslen, III et al. | |
| D699,563 | S | 2/2014 | McAdam | |
| D700,713 | S | 3/2014 | Williams, III | |
| 8,707,475 | B2 | 4/2014 | Johnson et al. | |
| D706,626 | S | 6/2014 | Lazar | |
| D709,363 | S | 7/2014 | Boehnen et al. | |
| 8,789,899 | B2 | 7/2014 | Pirro et al. | |
| 8,915,381 | B2 | 12/2014 | Brozak et al. | |
| D729,055 | S | 5/2015 | Lemnios et al. | |
| 9,108,775 | B2 | 8/2015 | Savakus | |
| D739,726 | S | 9/2015 | Lemnios et al. | |
| 9,340,373 | B2 * | 5/2016 | McHugh | B65D 85/46 |
| D758,771 | S | 6/2016 | Austin, III et al. | |
| D759,407 | S | 6/2016 | Denby | |
| D763,023 | S | 8/2016 | Austin, III et al. | |
| D767,380 | S | 9/2016 | Austin, III et al. | |
| 9,434,524 | B2 | 9/2016 | Kindig | |
| D777,018 | S | 1/2017 | Boehnen et al. | |
| D777,564 | S | 1/2017 | Boehnen et al. | |
| 9,676,543 | B2 | 6/2017 | Lemnios et al. | |
| D791,519 | S | 7/2017 | Jordan et al. | |
| 9,743,810 | B2 | 8/2017 | Schultz et al. | |
| 9,907,415 | B2 | 3/2018 | Boehnen et al. | |
| 10,984,688 | B2 * | 4/2021 | Cantwell | A47F 5/005 |
| 11,439,255 | B2 * | 9/2022 | Austin, III | A47F 7/0042 |
| 2001/0002660 | A1 | 6/2001 | Riga et al. | |
| 2001/0054258 | A1 | 12/2001 | Becken | |
| 2002/0134030 | A1 | 9/2002 | Conway | |
| 2002/0144375 | A1 | 10/2002 | Drucker et al. | |
| 2002/0157318 | A1 | 10/2002 | Teubert et al. | |
| 2003/0019982 | A1 | 1/2003 | Wing et al. | |
| 2003/0047528 | A1 | 3/2003 | Stein | |
| 2004/0159049 | A1 | 8/2004 | Teubert et al. | |
| 2004/0177437 | A1 | 9/2004 | Perry | |
| 2004/0238465 | A1 | 12/2004 | Mercure | |
| 2004/0245195 | A1 | 12/2004 | Pride | |
| 2005/0006332 | A1 | 1/2005 | Stein | |
| 2005/0115202 | A1 | 6/2005 | Mertz et al. | |
| 2005/0115860 | A1 | 6/2005 | Mertz et al. | |
| 2005/0236299 | A1 | 10/2005 | Weber et al. | |
| 2006/0043032 | A1 | 3/2006 | McHugh | |
| 2006/0196838 | A1 | 9/2006 | Mercure et al. | |
| 2006/0208150 | A1 | 9/2006 | Elmer et al. | |
| 2007/0045204 | A1 | 3/2007 | Huard et al. | |
| 2007/0295680 | A1 | 12/2007 | Budge | |
| 2008/0072499 | A1 * | 3/2008 | Sibbett | A47F 7/0042 49/374 |
| 2008/0073469 | A1 | 3/2008 | Mushan et al. | |
| 2008/0148639 | A1 | 6/2008 | Jakob-Bamberg et al. | |
| 2008/0148692 | A1 | 6/2008 | Wisecarver et al. | |
| 2008/0277363 | A1 | 11/2008 | McDonough | |
| 2009/0115299 | A1 | 5/2009 | Ricereto | |
| 2009/0250416 | A1 * | 10/2009 | Chookang | B65D 85/48 211/41.14 |
| 2010/0107497 | A1 | 5/2010 | Hulst et al. | |
| 2010/0181267 | A1 | 7/2010 | Theisen | |
| 2010/0264058 | A1 | 10/2010 | Krause | |
| 2011/0035871 | A1 | 2/2011 | Seymour et al. | |
| 2011/0113547 | A1 | 5/2011 | O'Connell | |
| 2012/0005822 | A1 | 1/2012 | Daubmann et al. | |
| 2012/0036628 | A1 | 2/2012 | O'Connell | |
| 2012/0233926 | A1 | 9/2012 | Chang et al. | |
| 2012/0259743 | A1 | 10/2012 | Pate, Jr. | |
| 2013/0093298 | A1 | 4/2013 | Ehmke et al. | |
| 2013/0140319 | A1 | 6/2013 | Tam et al. | |
| 2013/0161276 | A1 | 6/2013 | Breeden et al. | |
| 2013/0325670 | A1 | 12/2013 | Austin, III et al. | |
| 2014/0032447 | A1 | 1/2014 | Fisher | |
| 2014/0173990 | A1 | 6/2014 | Schachter et al. | |
| 2014/0237715 | A1 | 8/2014 | Wei | |
| 2014/0250795 | A1 | 9/2014 | Wei | |
| 2014/0259363 | A1 | 9/2014 | Ball et al. | |
| 2014/0290001 | A1 | 10/2014 | Hasegawa | |
| 2014/0319988 | A1 | 10/2014 | Dietz et al. | |
| 2014/0331564 | A1 | 11/2014 | Wei | |
| 2015/0096117 | A1 | 4/2015 | Forrest et al. | |
| 2015/0210113 | A1 | 7/2015 | Yang | |
| 2022/0133062 | A1 * | 5/2022 | Osiecki | A47F 5/0815 211/45 |

FOREIGN PATENT DOCUMENTS

| | | | | |
|---|---|---|---|---|
| CN | 204326804 | U | 5/2015 | |
| CN | 204370961 | U | 6/2015 | |
| DE | 2149016 | | 4/1973 | |
| DE | 9306878 | | 8/1993 | |
| DE | 202009004111 | U1 | 8/2009 | |
| EP | 0600506 | A2 * | 6/1994 | |
| EP | 1020154 | A2 | 7/2000 | |
| EP | 1623656 | A1 * | 2/2006 | A47F 3/06 |
| EP | 2317052 | A2 | 5/2011 | |
| EP | 2774519 | A1 | 9/2014 | |
| EP | 2982273 | A1 | 2/2016 | |
| GB | 827312 | | 2/1960 | |
| JP | 2001095657 | A | 4/2001 | |
| JP | 2003237846 | A | 8/2003 | |
| WO | 2005035396 | A2 | 4/2005 | |
| WO | 2005035396 | A3 | 4/2005 | |
| WO | 2008076224 | A1 | 6/2008 | |
| WO | 2008133531 | A1 | 11/2008 | |
| WO | 2009029358 | A1 | 3/2009 | |

OTHER PUBLICATIONS

Canada Office Action for Application No. 2,860,371, dated Oct. 23, 2020, 4 pages.

Europe Extended Search Report for Application No. 15152840.3, dated Nov. 9, 2015, 11 pages.

Europe Search Report for Application No. 15152840.3, dated Jun. 30, 2015, 6 pages.

http://www.johnsonhardware.com/doordisplay.htm, "Johnson Hardware Door Panel Display Unit", Dec. 16, 2010, 2 pages.

Mexico Office Action for Application No. MX/a/2014/013774, dated Apr. 21, 2017, 3 pages.

Mexico Office Action for Application No. MX/a/2014/013774, dated Aug. 15, 2017, 4 pages.

Mexico Office Action for Application No. MX/a/2014/013774, dated Jan. 18, 2018, 4 pages.

(56) References Cited

OTHER PUBLICATIONS

Quality Craft, "Installation Manual Shower Unit", Model No. 961WUX006WHI, Mar. 9, 2011, 14 pages.
www.thermatru.com/trade-professional/dpprgallerdisplays.aspx, "Door Gallery Displays", Jul. 10, 2010, 31 pages.
HouseImprovements, Video: "How To Install Glass Sliding Shower Doors," Oct. 4, 2012, https://www.youtube.com/watch?v-u88j284_jAk, 32:25.
Canada Office Action for Application No. 2,860,371, dated Dec. 23, 2021, 3 pages.
Non-Final Office Action for U.S. Appl. No. 17/344,050, dated Feb. 16, 2013, 8 pages.

* cited by examiner

SHOWER DOOR ASSEMBLY DISPLAY

CROSS-REFERENCE TO RELATED APPLICATIONS

This application is a continuation of U.S. application Ser. No. 17/344,050 filed Jun. 10, 2021, which is a division of U.S. application Ser. No. 16/058,244 filed Aug. 8, 2018, now U.S. Pat. No. 11,058,237 B2, which is a division of U.S. application Ser. No. 14/167,230 filed Jan. 29, 2014, now U.S. Pat. No. 10,070,739 B2, the disclosures of which are hereby incorporated in their entirety by reference herein.

U.S. application Ser. No. 17/344,050 filed Jun. 10, 2021, is also a division of U.S. application Ser. No. 15/950,400 filed Apr. 11, 2018, now U.S. Pat. No. 11,089,887 B2, which is a continuation of U.S. application Ser. No. 14/167,230 filed Jan. 29, 2014, now U.S. Pat. No. 10,070,739 B2, the disclosures of which are hereby incorporated in their entirety by reference herein.

TECHNICAL FIELD

Various embodiments relate to shower door assemblies; retail displays for displaying shower door assemblies; methods for manufacturing shower door components; and methods for installing shower door assemblies.

BACKGROUND

The prior art has provided shower door assemblies that are assembled and packaged for retail.

SUMMARY

According to at least one embodiment, a retail shower door display assembly is provided with a point-of-sale display unit sized to be received within a retail store aisle. A first array of shower door glass panes is oriented within the display unit. Each shower door glass pane of the first array has a height, a thickness and a width. A second array of shower door glass panes is oriented within the display unit. Each shower door glass pane of the second array has a height, a thickness and a width that is different than the width of the first array of shower door glass panes. An array of shower door tracks is oriented within the display unit. Each shower door track of the array has a common length.

According to at least one embodiment, a method of installing a shower door assembly provides at least one shower door track from an array of shower door tracks oriented within a point-of-sale display unit sized to be received within a retail store aisle of a retail shower display assembly, wherein each shower door track of the array has a common length. The at least one shower door track is installed. At least one shower door glass pane is provided from one of a first array of shower door glass panes oriented within the display unit, and a second array of shower door glass panes oriented within the display unit. Each shower door glass pane of the first array has a height, a thickness and a width. Each shower door glass pane of the second array has a height, a thickness and a width that is different than the width of the first array of shower door glass panes. The at least one shower door glass pane is installed to the at least one shower door track.

According to at least another embodiment, a retail shower door display assembly is provided with a point-of-sale display unit sized to be received within a retail store aisle. A first array of shower door glass panes is oriented within the display unit. Each shower door glass pane of the first array has a height, a thickness and a width. A second array of shower door glass panes is oriented within the display unit. Each shower door glass pane of the second array has a height, a thickness and a width, at least one of the height and the width is different than that of the first array of shower door glass panes. An array of towel bars is oriented within the display unit. Each towel bar of the array has a common length.

According to at least another embodiment, a method of installing a shower door assembly provides at least one shower door glass pane from one of a first array of shower door glass panes and a second array of shower door glass panes oriented within a point-of-sale display unit sized to be received within a retail store aisle of a retail shower door display assembly. Each shower door glass pane of the first array has a height, a thickness and a width. Each shower door glass pane of the second array has a height, a thickness and a width that is different than the width of the first array of shower door glass panes. At least one towel bar is provided from an array of towel bars oriented within the display unit. Each towel bar of the array has a common length. The at least one towel bar is installed to the at least one shower door glass pane.

According to at least one embodiment, a method of manufacturing shower door components is provided by forming a first plurality of shower door glass panes, each with a height, a thickness and a width. An aperture pattern is formed in each of the first plurality of shower door glass panes to mount a towel bar to the aperture pattern. Each of the first plurality of shower door glass panes is tempered after the aperture pattern is formed. A second plurality of shower door glass panes is provided, each with a height, a thickness and a width that is different than the width of the first plurality of shower door glass panes. An aperture pattern is formed in each of the second plurality of shower door glass panes, common to the aperture pattern formed in the first plurality of shower door glass panes, to mount a towel bar to the aperture pattern. Each of the second plurality of shower door glass panes is tempered after the aperture pattern is formed. A plurality of towel bars is provided, having a common mounting pattern to mount to the aperture pattern in the first plurality of shower door glass panes and the second plurality of shower door glass panes.

According to an embodiment, a shower door assembly is manufactured according to a method of manufacturing shower door components by forming a first plurality of shower door glass panes, each with a height, a thickness and a width. An aperture pattern is formed in each of the first plurality of shower door glass panes to mount a towel bar to the aperture pattern. Each of the first plurality of shower door glass panes is tempered after the aperture pattern is formed. A second plurality of shower door glass panes is provided, each with a height, a thickness and a width that is different than the width of the first plurality of shower door glass panes. An aperture pattern is formed in each of the second plurality of shower door glass panes, common to the aperture pattern formed in the first plurality of shower door glass panes, to mount a towel bar to the aperture pattern. Each of the second plurality of shower door glass panes is tempered after the aperture pattern is formed. A plurality of towel bars is provided, having a common mounting pattern to mount to the aperture pattern in the first plurality of shower door glass panes and the second plurality of shower door glass panes.

According to another embodiment, a shower door assembly is manufactured according to a method of manufacturing shower door components by forming a first plurality of shower door glass panes, each with a height, a thickness and a width. An aperture pattern is formed in each of the first plurality of shower door glass panes to mount a towel bar to the aperture pattern. Each of the first plurality of shower door glass panes is tempered after the aperture pattern is formed. A second plurality of shower door glass panes is provided, each with a height, a thickness and a width that is different than the width of the first plurality of shower door glass panes. An aperture pattern is formed in each of the second plurality of shower door glass panes, common to the aperture pattern formed in the first plurality of shower door glass panes, to mount a towel bar to the aperture pattern. Each of the second plurality of shower door glass panes is tempered after the aperture pattern is formed. A plurality of towel bars is provided, having a common mounting pattern to mount to the aperture pattern in the first plurality of shower door glass panes and the second plurality of shower door glass panes. A plurality of shower door tracks are formed each having a common length.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Conventional shower door assemblies are typically retailed pre-bundled or prepackaged. Conventional shower door assemblies typically include shower door glass panes, shower door tracks, and shower hardware assemblies. The preassembled retail of these assemblies limits consumer options, while providing an overall unit that is relatively large and consequently difficult to transport from the point-of-sale to the point of installation. The preassembled unit may also be difficult to install.

Conventional shower door assemblies are often provided in varying sizes and styles. Therefore, for each style, shower door glass panes, shower door tracks, and towel bars are often provided specific to each standard sized for the shower door assemblies. All of the components required for the varying sizes and styles results in a large number of components to manufacture and retail.

Figure 1:
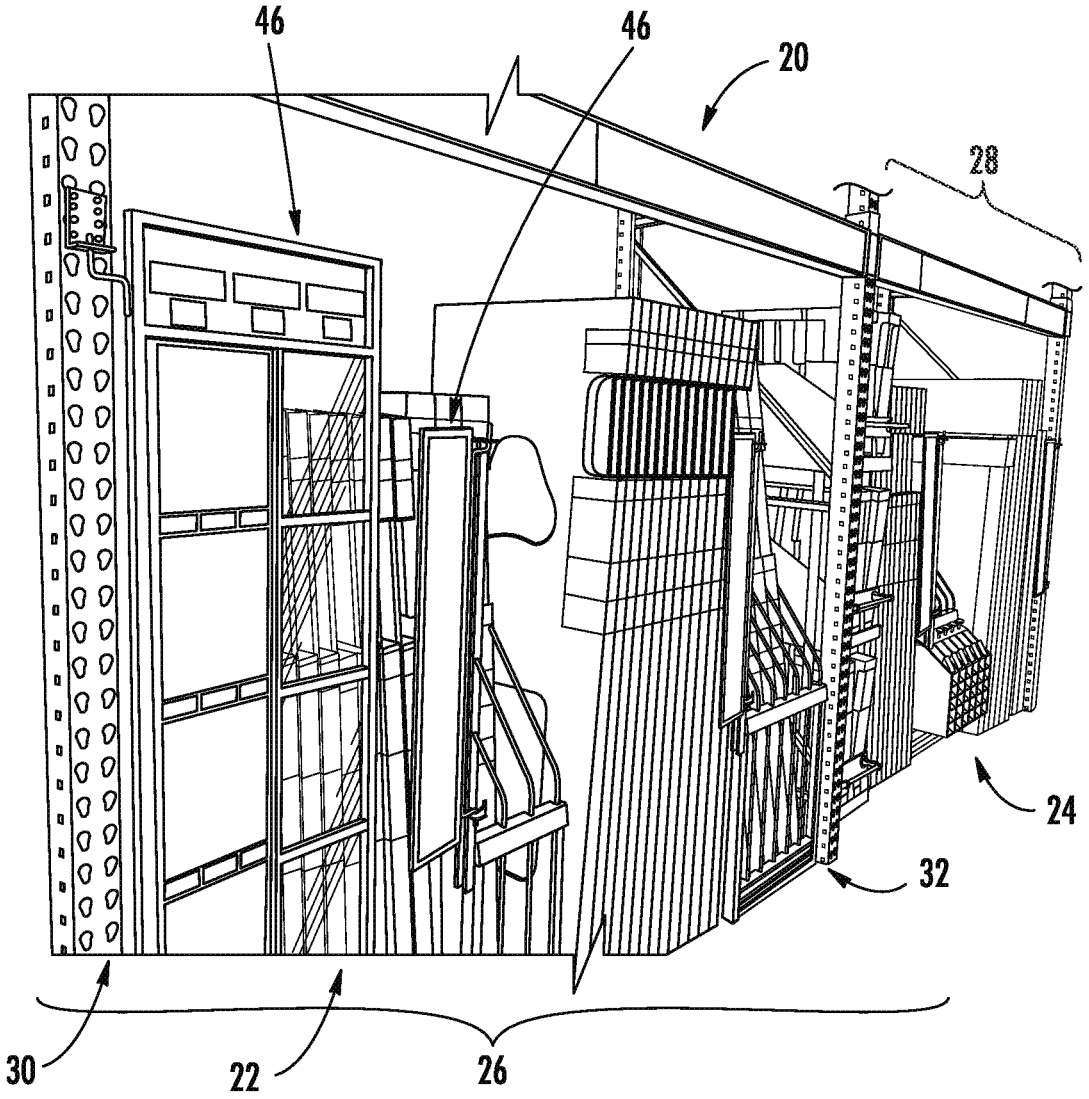
FIG. 1 is a perspective view of retail shower door display system according to an embodiment.
Figure 2:
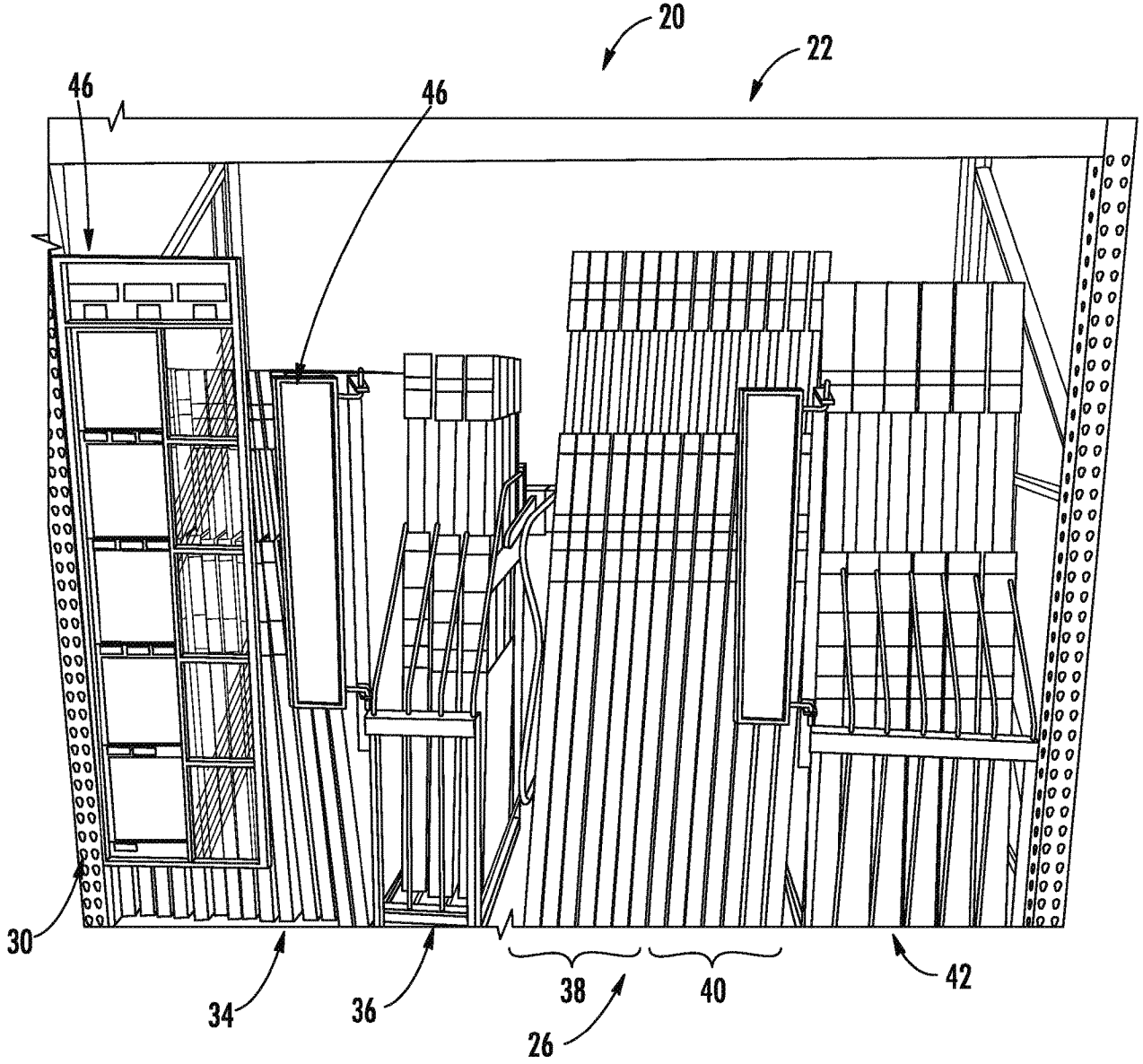
FIG. 2 is a front perspective view of a retail shower door display assembly of FIG. 1.
Figure 3:
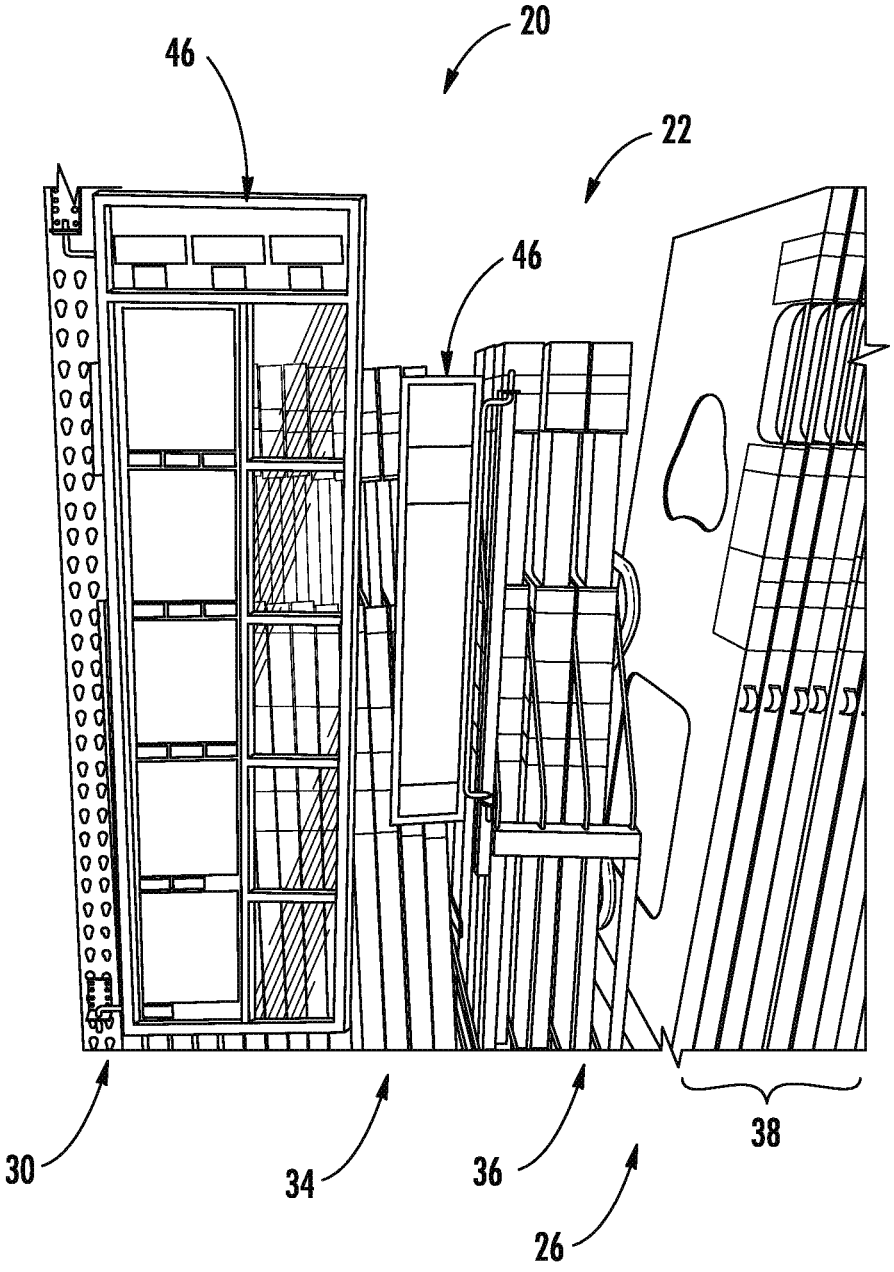
FIG. 3 is an enlarged front perspective view of signage of the retail shower door display assembly of FIG. 2.
Figure 4:
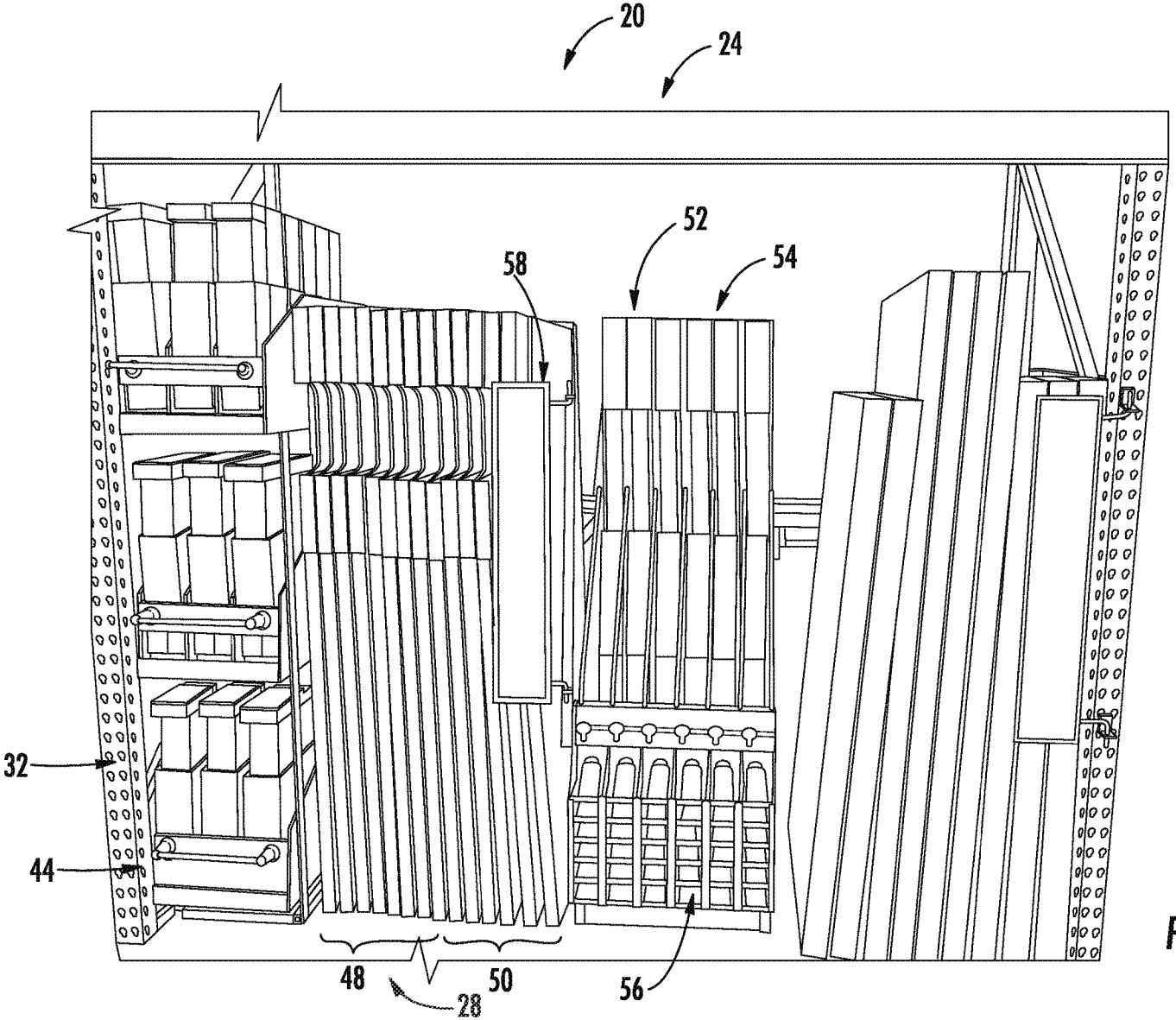
FIG. 4 is a front perspective view of another retail shower door display assembly of FIG. 1.

Referring now to FIG. 1, a retail shower door display system is illustrated according to an embodiment, and referenced generally by numeral 20. The display system 20 is provided by, for example, a pair of retail shower door display assemblies 22, 24. The display system 20 is sized to be displayed within a retail store aisle, such as a home improvement store. The display system 20 is utilized for both displaying and retailing shower door components.

Shower door assemblies are conventionally categorized by function or type. For example, shower door assemblies include sliding shower door assemblies 26 and pivoting shower door assemblies 28. The first decision a consumer of shower door assemblies may need to decide is which style or category 26, 28 of shower door assembly is desired. Once the consumer selects a category 26, 28, the consumer may approach the corresponding display assembly 22, 24.

The retail shower door display system 20 includes a pair of point-of-sale display units 30, 32. Of course, any number of point-of-sale display units is contemplated; and as will be explained, it is advantageous to provide the greatest variety of products per each point-of-sale display unit 30, 32. The point-of-display units 30, 32 are sized to be received within a retail store aisle; and may be sized the same as conventional shelving for preassembled doors for easy replacement.

The sliding shower door assembly 26 includes an array of shower door glass panes 34, which may be for sliding tub doors, for example. The shower door glass panes 34 may vary in style. The shower door glass panes 34 each have a standard height, a standard thickness, and a standard width for that application. An array of shower door tracks 36 is provided in the display unit 30 with standard dimensions for the sliding tub door application. The tracks 36 may also vary in style. The separate packaging permits the customer to select from a large combination of varieties due to the interchangeability of the glass panes 34 and the tracks 36. The tracks 36 depicted are guide tracks 36 for sliding a pair of shower door glass panes 34 within the guide tracks 36. Alternatively to, or in addition to, the tracks 36 may be frames for the shower door glass panes 34.

The sliding shower door assemblies 26 also include an array of shower door glass panes 38 for sliding shower doors. The shower door glass panes 38 include a standard height, which is typically greater than that for a sliding tub door. The shower door glass panes 38 have a standard thickness, and a standard width, for example, to span up to a forty-eight inch shower door opening. Another array of shower door glass panes 40 is provided similar to the shower door glass panes 38, except, the second array of sliding shower doors glass panes 40 have a greater standard width, such as to span up to a sixty inch shower door opening.

The sliding shower door assemblies 26 include an array of shower door tracks 42 for a sliding shower doors, which according to one embodiment all have a common length only, for example the greater of the standard shower door opening size of sixty inches. According to another embodiment, the array may include sets of tracks 42 in a first length, such as forty-eight inches and sets of tracks 42 in a second length, such as sixty inches. The array of shower door tracks 42 may include shower door tracks in various finishes, such as chrome, nickel and bronze. No other tracks are provided for sliding shower doors to minimize space occupied in the display unit 30. A customer requiring a shorter track purchases one of the tracks 42; and shortens the track 42 prior to installation. By providing only one track size for different size shower door glass panes 38, 40 manufacturing costs are lowered, providing a cost-savings to the end customer, while reducing space required in the display unit 30.

Next, an array of towel bars 44 is oriented within the display unit 32. Each towel bar 44 of the array has a common length. Additionally, each towel bar 44 has a common mounting pattern. Likewise, each of the shower door glass panes 34, 38, 40 each have a common aperture pattern that corresponds to the common mounting pattern of the towel bars 44. By providing one standardized towel bar 44 size, various combinations with each of the shower door glass panes 34, 38, 40 can be achieved while providing a vast reduction to shelf space. In order to meet this end, the aperture patterns are formed in the glass panes 34, 38, 40 prior to tempering. By standardizing the aperture patterns, manufacturing costs are also minimized.

The retail shower door display system 20 also includes signage 46 for explaining the sequence for a customer to select the components for a shower door assembly 26, 28. The glass panes 34, 38, 40 are provided sequentially prior to the tracks 36, 42 because customers typically select the glass panes 34, 38, 40 first since it is the largest aesthetic and functional component of the assembly 26, 28.

The display unit 32 also includes a pair of arrays of shower door glass panes 48, 50 for pivoting shower door assemblies 28 in two standard sizes, such as thirty-one inches and thirty-six inches by way of example. A pair of arrays of shower tracks 52, 54 for the pivoting shower door assemblies 28 are also provided in the two standard sizes. An array of pull handles 56 is provided for use with the various shower door glass panes 48, 50. Signage is provided to explain the sequence for selecting components.

The retail shower door display system 20 provides a large variation of shower door assemblies 26, 28 without limits provided in prepackaged assemblies. Interchangeability of tracks 36, 42, 52, 54, towel bars 44 and pull handles 56 further saves shelf space. The pull handles 56 are provided in multiple finishes, such as chrome, nickel and bronze, and are sized to be mounted to either size glass pane 48, 50. In the depicted embodiment, 183 combinations are provided in less than two display units 30, 32, which if prepackaged as in the prior art, would require almost eight display units.

The retail shower door display system 20 allows the consumer to custom configure a shower door based on the consumer's selection. The retail shower door display system 20 enables the consumer to mix and match style, finish, and glass textures for a customized sliding-tub shower door assembly 26, sliding shower door assembly 26 or a pivot shower door assembly 28. The retail shower door display system 20 permits the manufacture to retail more Stock Keeping Units (SKUs) in the retail shower door display system 20 than would be practical with traditional preassembled and prepackaged shower door assemblies. The consumer can avoid having to lift, carry and transport a single total weight package due to the separation of the components. Consumers can also more readily transport components in vehicles due to an ability to place each packaged component in a vehicle interior and trunk due to separate packaging. Also, the customer can purchase replacement parts without a need to replace an entire shower door assembly in case of component repair when a specific component requires replacement, but the entire assembly does not require replacement. The customer can purchase replacement parts for new remodeling efforts where a glass or frame finish change is desired. The customer can purchase replacement parts for future product maintenance when one or more components require replacement due to wear or damage.

The manufacturer can also avoid steps of shipping the components to a common facility for assembling and packaging. The manufacturer can also more readily maintain inventory; easily add new products to the retail shower door display system 20; and regionalize the product mix.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A retail shower door display comprising:

a point-of-sale display;

a first array of shower door glass panes oriented within the display, each shower door glass pane of the first array having a height, a thickness, and a width for a first shower door opening;

a second array of shower door glass panes oriented within the display, each shower door glass pane of the second array having a height, a thickness, and a width for a second shower door opening that is different than the width of the first array of shower door glass panes;

an array of shower door tracks oriented within the display, each shower door track of the array configured to be sized for a first shower door opening and the second shower door opening;

only one array of towel bars oriented within the display, each towel bar of the array having a common length; and signage containing numerical indicia that corresponds to the first array of shower door glass panes, the array of shower door tracks and the only one array of towel bars, providing a sequenced guide for user selection from the array.

2. The retail shower door display of claim 1 wherein the array of shower door tracks is adapted to be shortened to correspond to first shower door opening.

3. The retail shower door display of claim 1 wherein an aperture pattern is formed in each of the first array of shower door glass panes to mount a towel bar to the aperture pattern.

4. The retail shower door display of claim 1 wherein the first and second arrays of shower door glass panes, the array of shower door tracks, and the array of towel bars are oriented sequentially for user selection of a shower door glass pane first, a shower door track second, and subsequently a towel bar third.

5. The retail shower door display of claim 3 wherein an aperture pattern is also formed in each of the second array of shower door glass panes to mount a towel bar to the aperture pattern.

6. The retail shower door display of claim 5 wherein the aperture pattern formed in the first array of shower door glass panes corresponds to the aperture pattern formed in the second array of shower door glass panes.

7. A shower door retail assembly comprising:

a first array of separately packaged shower door glass panes, each shower door glass pane of the first array having a height, a thickness, and a width;

a second array of separately packaged shower door glass panes, each shower door glass pane of the second array having a height, a thickness, and a width that is different in width of the first array of shower door glass panes;

an array of shower door tracks, each shower door track of the array configured to be sized for a first shower door opening and a second shower door opening;

only one array of towel bars packaged within a display, each towel bar of the array having a common length; and signage containing numerical indicia that corresponds to at least the first array of shower door glass panes, the array of shower door tracks and the only one array of towel bars in the display, providing a sequenced guide for selection from the array.

8. A retail shower door display assembly comprising:

a retail display unit;

a first array of separately packaged shower door glass panes oriented within the display unit, each shower door glass pane of the first array having a height, a thickness, and a width for a first shower door opening;

a second array of separately packaged shower door glass panes oriented within the display unit, each shower door glass pane of the second array having a height, a thickness, and a width for a second shower door opening that is different than the width of at least one of the first array of shower door glass panes;

an array of separately packaged shower door tracks oriented within the display unit, each shower door track of the array configured to be sized for a shower door opening of the first shower door opening and the second shower door opening; and signage indicia on the packaging that corresponds to a sequenced choice of shower door glass panes and shower door tracks from the retail display.

9. The retail shower door display assembly of claim 8 wherein the array of shower door tracks is configured to be shortened to correspond to first shower door opening.

10. The retail shower door display assembly of claim 8 wherein the first array of shower door glass panes is sized to span a forty-eight inch shower door opening.

11. The retail shower door display assembly of claim 8 wherein the second array of shower door glass panes are sized to span a sixty inch shower door opening.

12. The retail shower door display assembly of claim 8 further comprising an array of towel bars oriented within a display unit, each towel bar of the array having a common mounting pattern that corresponds to apertures formed in the first array of shower door glass panes.

13. The retail shower door display assembly of claim 12 wherein the first and second arrays of shower door glass panes, the array of shower door tracks, and the array of towel bars are oriented sequentially based on a predetermined pattern for user selection of the shower door glass pane first, the shower door track second, and subsequently the towel bar third.

* * * * *